US006420667B1

(12) United States Patent
Miwa et al.

(10) Patent No.: US 6,420,667 B1
(45) Date of Patent: Jul. 16, 2002

(54) COMPOUND SWITCH DEVICE

(75) Inventors: Toshitaka Miwa; Toshio Takahashi, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/924,978

(22) Filed: Aug. 8, 2001

(30) Foreign Application Priority Data

Aug. 22, 2000 (JP) ..... 2000-255742

(51) Int. Cl.[7] ..... H01H 9/00
(52) U.S. Cl. ..... 200/4; 200/5 R; 200/11 R
(58) Field of Search ..... 200/4, 5 R, 6 R, 200/7, 11 R, 18, 336, 341, 313, 314

(56) References Cited

U.S. PATENT DOCUMENTS 4,166,200 A * 8/1979 Reichen et al. ..... 200/11 R
4,410,774 A * 10/1983 Houpt et al. ..... 200/14
4,527,023 A * 7/1985 Ohashi et al. ..... 200/11 G
4,625,084 A * 11/1986 Fowler et al. ..... 200/11 DA
5,049,709 A * 9/1991 Prickett et al. ..... 200/527
5,607,611 A * 3/1997 Lee ..... 219/702
5,894,118 A * 4/1999 Nishimoto et al. ..... 200/527
5,959,267 A 9/1999 Kawasaki et al.
6,080,942 A * 6/2000 Sasaki ..... 200/17 R

* cited by examiner

*Primary Examiner*—Elvin Enad
*Assistant Examiner*—Kyung S. Lee
(74) *Attorney, Agent, or Firm*—Brinks Hofer Gilson & Lione

(57) ABSTRACT

There will be provided a compound switch device that is miniaturized in the direction of its outer diameter, that is easy to assemble. The printed circuit board 30 is placed on the housing 16 of the rotary switch 10 so as to oppose the rotary disk 15; with the protruded portion 19*b* of the holding portion 19 penetrated the through hole 30*b* of the printed circuit board. The operating unit is placed on the printed circuit board so as to dispose the illuminated element 32 and the push switch 20 within the operating unit. The operating unit is arranged such that the second operating member 21 opposes to the push switch and is illuminated by the illuminated element. The protruded portion of the holding portion is fixed to the rotary switch, and the printed circuit board is caught between the rotary switch and the operating unit. The protruded portion is engaged with the first operating member in such a manner that the rotation of the first operating member operates the rotary switch, and the pressure to the second operating member operates the push switch.

4 Claims, 3 Drawing Sheets

COMPOUND SWITCH DEVICE

BACKGROUND OF THE INVENTION

1. Field of the Invention

The present invention relates to a compound switch device, and more particularly to a compound switch device comprising a rotary switch and a push switch combined.

2. Description of the Related Art

The description will be made of a conventional compound switch device.

In the conventional compound switch device comprising a rotary switch and a push switch combined, the rotary switch is a rotary switch of a so-called donut type in external shape, within a gap portion at the central portion of this donut type rotary switch, there is disposed the push switch, and both the rotary switch and the push switch are constructed to be connected together on a common printed circuit board.

At this time, a rotary operating unit of the rotary switch and a pressing operating unit of the push switch are coaxial to a rotating shaft of the rotary switch, and are disposed on the gap portion at the central portion of the rotary switch. For this reason, space area having a predetermined volume is required to dispose the push switch.

Also, since the push switch is disposed within the gap portion at the central portion of the donut type rotary switch, it is difficult to install and arrange the push switch into the rotary switch, and it is not easy to install.

This conventional compound switch device has been constructed such that within a hollow portion at the central portion of the donut type rotary switch, there is disposed the push switch; and both the rotary switch and the push switch are connected to a common printed circuit board in such a manner that a rotating operation of the rotary switch and a pressing operation of the push switch are performed by operating each operating member coaxially disposed. For this reason, since the push switch is disposed within the hollow portion of the rotary switch, the hollow portion for disposing the push switch requires space area having a predetermined volume, and this leads a problem that an external (diameter) dimension of the donut type rotary switch becomes larger and the external (diameter) dimension of this compound switch device becomes larger.

Also, since the push switch is to be disposed within the hollow portion of the rotary switch, there is a problem that it is difficult in terms of space to install the push switch into the hollow portion, and it is difficult to install.

SUMMARY OF THE INVENTION

The present invention has been achieved in order to solve the above-described problems, and is aimed to provide a compound switch device which has been miniaturized in the direction of the outer diameter, and easy to assemble.

A compound switch device according to the present invention has a rotary switch, a printed circuit board in which an illuminated element and a push switch are connected together, and an operating unit, the rotary switch having a housing, a rotary disk disposed within the housing, and a protruded portion formed on the rotary disk, protruding outwardly from the housing; the printed circuit board having a through hole; the operating unit having a cylindrical first operating member which is rotating, a second operating member disposed within the first operating member, for being pressed in a direction parallel to a rotating shaft of the first operating member, a cylindrical holding portion for holding the first operating member and the second operating member, and a protruded portion for protruding outwardly from the holding portion; the printed circuit board being placed on a housing for the rotary switch so as to oppose to the rotary disk; the operating unit being placed on the printed circuit board so as to arrange the illuminated element and the push switch within the operating unit by causing the protruded portion of the holding portion to penetrate the through hole of the printed circuit board; the second operating member being caused to oppose to the push switch and to be illuminated by the illuminated element; the protruded portion of the holding portion being fixed to the rotary switch; the printed circuit board being caught between the rotary switch and the operating unit; the protruded portion of the rotary switch being engaged with the first operating member of the operating unit; by means of rotation of the first operating member, the rotary disk being rotated to operate the rotary switch; and by pressing the second operating member, the push switch being operated. With the above-described structure, a compound switch device comprising the rotary switch and the push switch laminated through the printed circuit board is constituted, and the effect is exhibited that the external (direction of diameter) dimension of this compound switch device can be miniaturized, and it becomes possible to assemble and it becomes easy to assemble only by fixing the rotary switch to the holding portion of the operating unit for making them integral.

Also, in the compound switch device according to the present invention, the protruded portion of the rotary disk of the rotary switch rotates along an outer peripheral edge portion of the printed circuit board, and a range of rotation of the rotary disk is regulated by the protruded portion abutting against a part of the printed circuit board. Such structure exhibits the effect that a number of components can be reduced and the device can be supplied at low cost because the printed circuit board can be used also as a rotary stopper of the rotary switch.

Also, the compound switch device according to the present invention has the rotary switch for switching a large current and the push switch for switching a small current. Such structure exhibits the effect that it is possible to provide a compound switch device having a switching function capable of switching different currents.

DETAILED DESCRIPTION OF THE PREFERRED EMBODIMENTS

Figure 1:
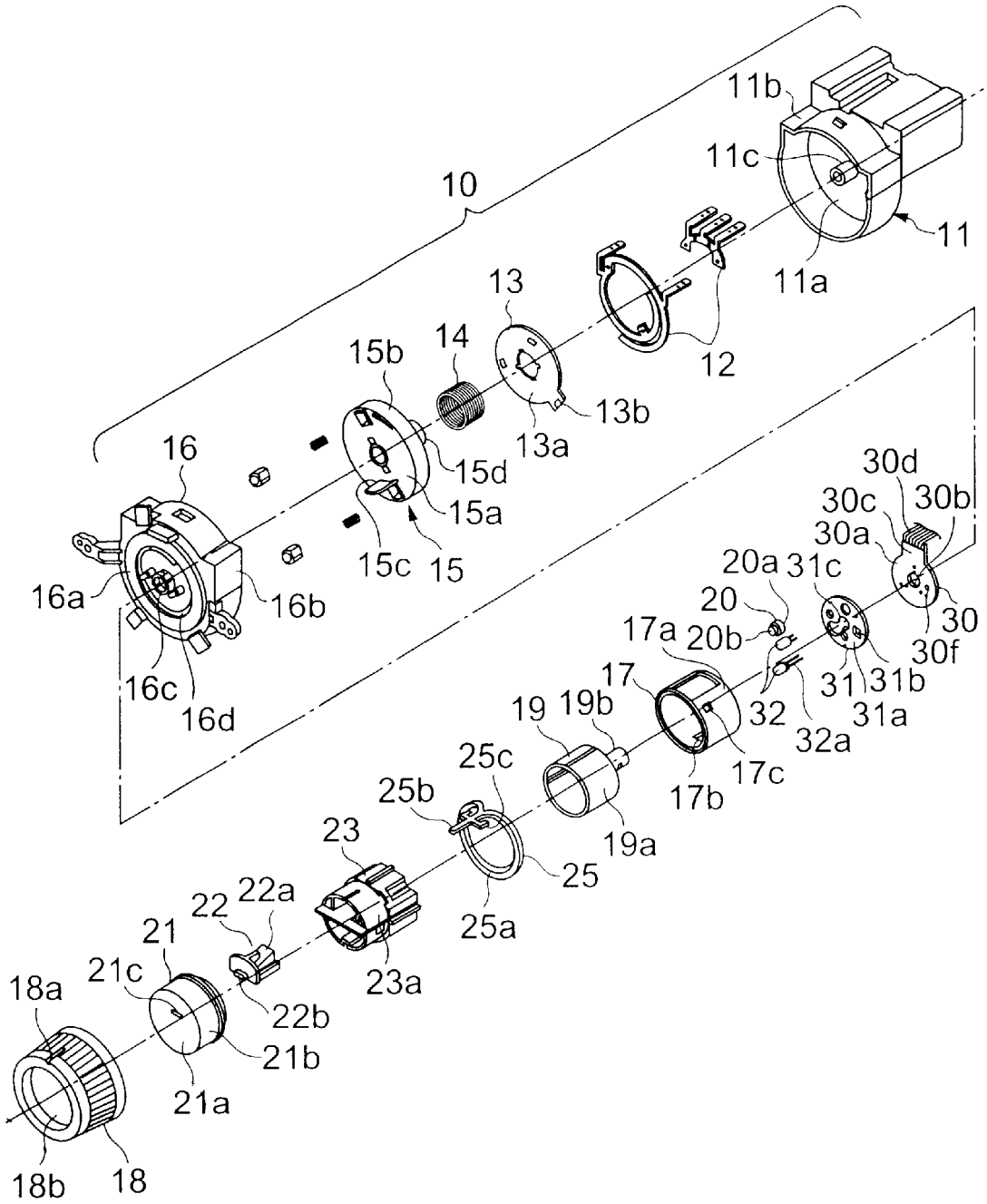
FIG. 1 is an exploded perspective view showing a compound switch device according to an embodiment of the present invention.

Hereinafter, with reference to the drawings, the description will be made of a compound switch device according to an embodiment of the present invention. FIG. 1 is an exploded perspective view showing a compound switch device according to the embodiment of the present invention, FIG. 2 is a perspective view showing a compound switch device according to the embodiment of the present invention; and FIG. 3 is a cross-sectional view showing a compound switch device according to the embodiment of the present invention.

Figure 2:
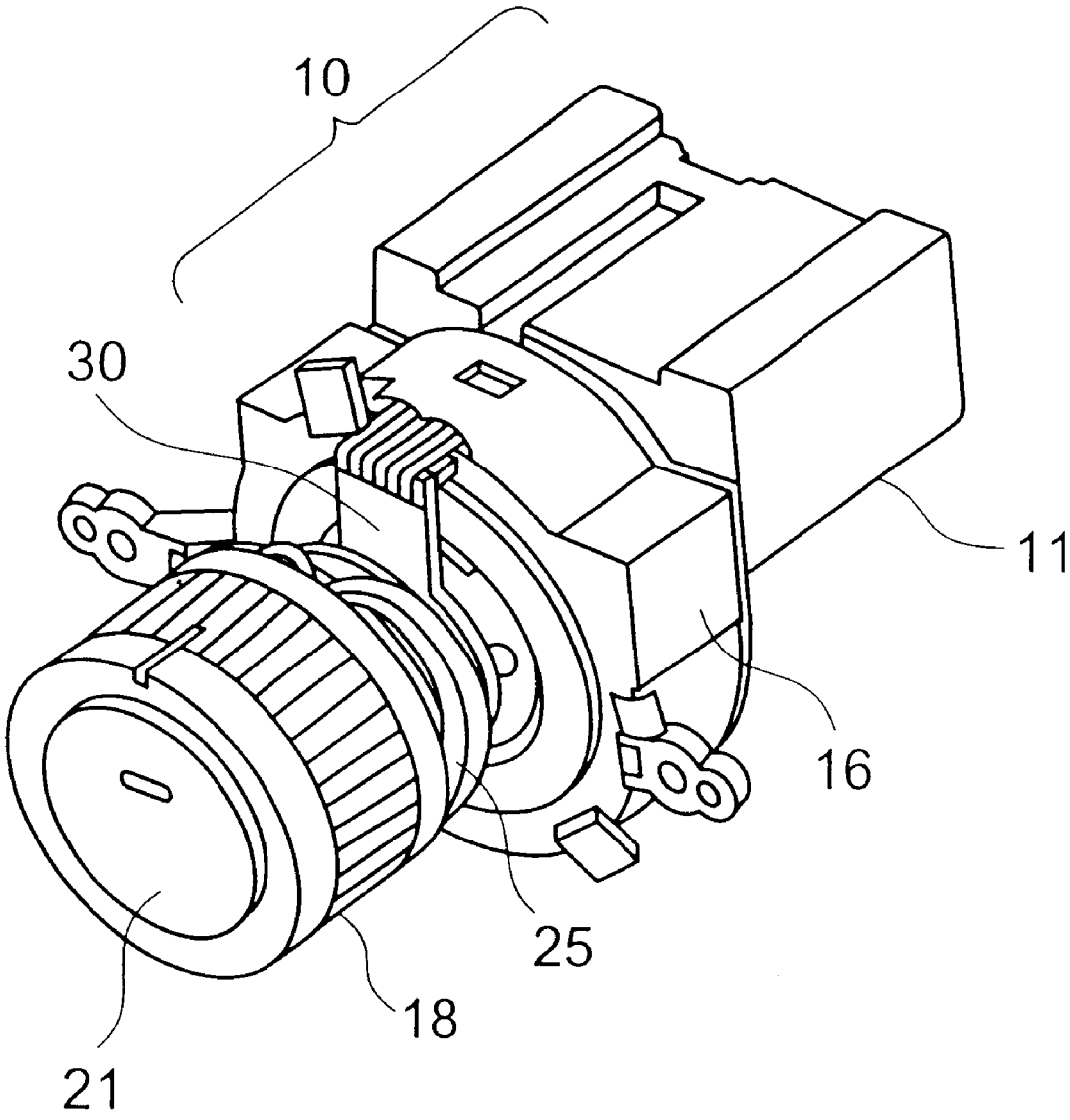
FIG. 2 is a perspective view showing a compound switch device according to the embodiment of the present invention.
Figure 3:
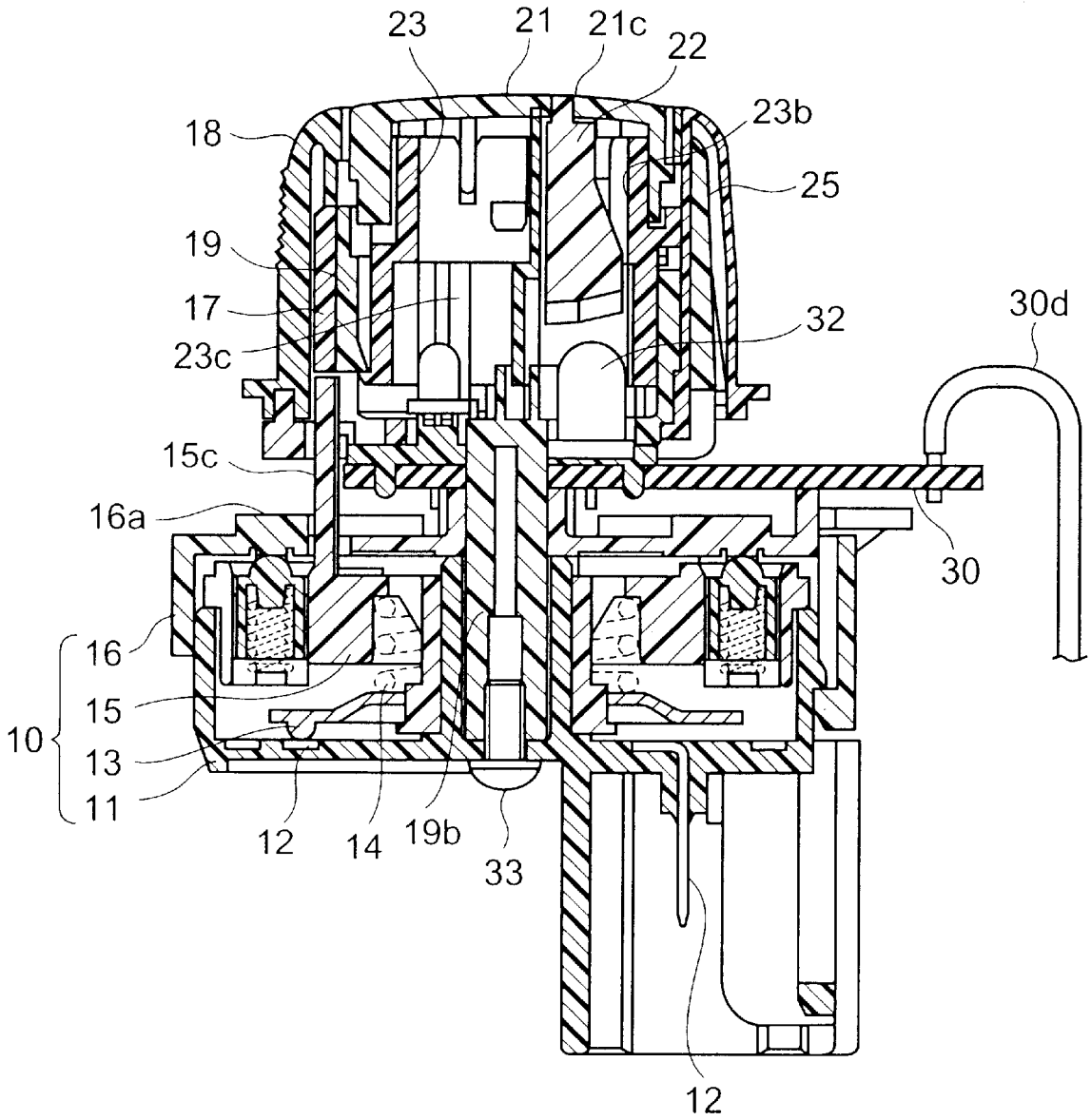
FIG. 3 is a cross-sectional view showing a compound switch device according to the embodiment of the present invention.

As shown in FIGS. 1 to 3, the compound switch device is generally constructed by a rotary switch 10 having a rotary slider 15 as a rotary disk; a push switch 20 having a push button 21 for being pressed in a direction parallel to a rotating shaft of the rotary slider 15; and a printed circuit board 30, to which the push switch 20 is connected.

This rotary switch 10 is a switch for switching such a large current as to switch supply current to a motor, which switches an air flow of, for example, an air conditioner, and the push switch 20 is a switch for switching such a small current as to switch current of a light source which illuminates, for example, a push button 21.

The rotary switch 10 has a lower housing 11; a plurality of (for example, five) stationary contact portions 12 disposed on the lower housing 11 by means of insert molding so as to expose its surface. The rotary switch 10 also has a movable contact portion 13 which opposes to the stationary contact portion 12 and abuts against each stationary contact portion 12 as well as a coiled spring 14 for pressing the movable contact portion 13 in the direction of the stationary contact portion 12. A rotary slider 15 for holding the coiled spring 14, and is a substantially circular rotary disk capable of rotating. The rotating switch also includes an upper housing 16 in which the rotary slider 15 is housed and disposed.

Also, this rotary switch 10 has a substantially cylindrical rotating slider 17 as a holding member for rotating the rotary slider 15, and a rotary knob 18 as a rotary finger grip restrained on the rotating slider 17 by appropriate means such as, for example, snap engagement. The rotating slider 17 and the rotary knob 18 constitute a cylindrical first operating member which can rotate.

Also, the lower housing 11 is made of synthetic resin material, is formed by fabrication, and has a substantially circular plate-shaped lower wall 11*a*, a side wall 11*b* extended vertically from an outer peripheral edge portion of the lower wall 11*a*, and a cylindrical portion 11*c* extruding from the central portion of the lower wall 11*a*.

The plurality of (for example, five) stationary contact portions 12 are made of a metallic flat plate, are formed by press working, and are disposed on the lower wall 11*a* by insert molding in such a manner that their surfaces are exposed.

Also, the movable contact portion 13 is made of a metallic flat plate, is formed by press working, and has a substantially circular plate-shaped proximal portion 13*a*, and a plurality of (for example, three) movable contacts 13*b* protruding outwardly from predetermined places of the proximal portion 13*a*.

The rotary slider 15 as a rotary disk is made of synthetic resin material, is formed by fabrication, and has a substantially circular plate-shaped upper wall 15*a*, a side wall 15*b* extended vertically from an outer peripheral edge portion of the upper wall 15*a*, a protruded portion 15*c* extended vertically (outwardly) from a predetermined place of the upper wall 15*a*, and a cylindrical portion 15*d* extending from the central portion of the upper wall 15*a*.

The upper housing 16 is made of synthetic resin material, is formed by fabrication, and has a substantially circular plate-shaped upper wall 16*a*, a side wall 16*b* extended vertically from an outer peripheral edge portion of the upper wall 16*a*, a cylindrical portion 16*c* protruding from the central portion of the upper wall 16*a*, and a circular arc-shaped through hole 16*d* formed on the upper wall 16*a* at a predetermined distance from the shaft center of the cylindrical portion 16*c*. In the through hole 16*d* of this upper housing 16, the protruded portion 15*c* of the rotary slider 15 is inserted, and a tip end portion of the protruded portion 15*c* is disposed to protrude outwardly from the upper wall 16*a* of the upper housing 16. In this state, within the upper housing 16, the rotary slider 15 is housed and disposed.

The movable contact portion 13 and the coiled spring 14 are held by the rotary slider 15 to be made integral, and rotation of the rotary slider 15 rotates the movable contact portion 13 together. The movable contact portion 13 and the coiled spring 14 are disposed in such a manner that the rotation of the movable contact portion 13 causes each movable contact 13*b* of the movable contact portion 13 to slidably contact on each stationary contact portion 12.

This rotary switch 10 is constructed such that the rotation of the rotary slider 15 causes the movable contact portion 13 to rotate together, and to slidably contact on each stationary contact portion 12, and then each contact portion is switched so as to obtain electric characteristics (electric signal) made variable.

The rotating slider 17 of this rotary switch 10 is made of synthetic resin material, is formed by fabrication, and has a cylindrical portion 17*a*, which is substantially cylindrical, a recess 17*b* provided at a predetermined place on the outer peripheral surface of the cylindrical portion 17*a* on one end portion side, and a pair of claws 17*c* provided at predetermined places on the outer peripheral surface of the cylindrical portion 17*a* on the other end portion side. Since the protruded portion 15*c* is engaged within the recess 17*b*, the recess 17*b* of this rotating slider 17 and the protruded portion 15*c* of the rotary slider 15 (rotary disk) are constructed such that the rotary slider 15 rotates with rotation of the rotating slider 17.

A rotary knob 18 of this rotary switch 10 is made of synthetic resin material, is formed by fabrication, and has a substantially cylindrical operating unit 18*a* and a circular through hole 18*b* provided at one end portion of the operating unit 18*a*. This rotary knob 18 houses the rotating slider 17, and the rotary knob 18 and the rotating slider 17 are made integral by appropriate means such as snap-in engagement using, for example, the claw 17*c*. Accordingly, the rotary knob 18 and the rotating slider 17 are disposed so as to rotate together in an integrated state, and constitute a so-called first operating member. This first operating member is disposed so as to be coaxial to the rotary slider 15 as the rotary disk.

The printed circuit board 30 is made of insulated synthetic resin material, is formed in a flat plate shape by fabrication, and has a circular plate-shaped proximal portion 30*a*, a round hole 30*b* as a through hole provided at the central portion of the proximal portion 30*a*, a derived portion 30*c* extended from a portion of the outer peripheral edge portion of the proximal portion 30*a* outwardly in a flush surface shape with the proximal portion 30*a*. The printed circuit board 30 further includes a plurality of derived terminal portions 30*d* formed at the tip end portion of the derived portion 30*c*, a pair of holes 30*f* formed at predetermined places on the proximal portion 30*a*, and a plurality of terminal portions (not shown) formed at predetermined places on the proximal portion 30*a*.

Also, at least on one surface of the printed circuit board 30, there is formed a predetermined circuit pattern although not shown.

This printed circuit board 30 is disposed on the upper wall 16*a* of the upper housing 16 of the rotary switch 10 by appropriate means such as engagement, and is made integral.

A holder 31 is made of synthetic resin material, is formed by fabrication, and has a circular plate-shaped proximal portion 31*a*, a plurality of round holes 31*b* provided at predetermined positions of the proximal portion 31*a*, a through hole 31*c* provided at the central portion of the proximal portion 31*a*, and a pair of boss portions (not shown) vertically protruded outwardly from one surface of the proximal portion 31*a*.

The boss portions (not shown) of this holder 31 are inserted (press-fitting) into holes 30*f* of the printed circuit board 30, and the holder 31 and the printed circuit board 30 are made integral.

A light source 32 as an illuminated element is, for example, a light emitting diode (LED) lamp, a krypton lamp or the like, has predetermined illumination, and a plurality of terminals 32*a* are disposed. This light source 32 is housed within the round hole 31*b* of the holder 31, the terminal 32*a* is inserted into a terminal portion (not shown) of the printed circuit board 30, and the terminal 32*a* is connected to the terminal portion by soldering. Since the light source 32 is housed within the round hole 31*b* in this state, the light source 32 can be reliably positioned. One or a plurality of the light sources 32 are provided on the printed circuit board 30 as occasion arises.

A cylinder-shaped slider 19 as a holding portion is made of synthetic resin material, is formed by fabrication, and has a cylinder-shaped cylindrical portion 19*a*, and a substantially circular column-shaped strut 19*b* that protrudes outwardly from one end portion of the cylindrical portion 19*a* in a direction that coincides with the shaft center.

This cylinder-shaped slider 19 is housed and disposed within the cylindrical portion 17*a* of the rotating slider 17, the strut 19*b* penetrates a through hole 31*c* of the holder 31 and a round hole 30*b* of the printed circuit board 30, and the tip end portion of this strut 19*b* is fixed to the lower housing 11 of the rotary switch 10 by means of a screw 33 (See FIG. 3).

In this state, the rotating slider 17 is disposed so as to be able to rotate on the outer peripheral surface of the cylinder-shaped slider 19. This cylinder-shaped slider 19 constitutes a part of the operating unit as a so-called holding portion.

A rotating light-guiding member 25 is made of synthetic resin material having light-guiding property capable of guiding light such as, for example, acrylics, is formed by fabrication, and has an annular portion 25*a*, which is substantially annular, a substantially square column-shaped derived portion 25*b* extended from a part of the annular portion 25*a* outwardly in parallel to the central axis of the annular portion 25*a*, and a pair of restraining portions 25*c* extended from the derived portion 25*b* in the direction of the central axis of the annular portion 25*a*.

This rotating light-guiding member 25 is restrained on the rotating slider 17 by appropriate means, and is disposed so as to rotate together by the rotation of the rotating slider 17. The tip end portion of the derived portion 25*b* is disposed on a part of the operating unit 18*a* of the rotary knob 18 side by side. Also, the rotary knob 18, the rotating light-guiding member 25 and the rotating slider 17 are made integral, and are disposed so as to rotate together by the rotation of the rotary knob 18.

The push switch 20 is operated by the push button 21, a light-guiding body 22 for guiding light so as to illuminate a predetermined place of the push button 21, and a substantially cylinder-shaped push slider 23 to be operated together with the push button 21 by pressing the push button 21, and is constructed so as to be operated ON and OFF by pushing the push switch 20 of the push slider 23.

The push button 21 and the push slider 23 constitute a second operating member, by which the push switch 20 is pressed.

Also, the push switch 20 has a housing 20*a*, an operating unit 20*b* protruded outwardly from one surface of the housing 20*a*, and a plurality of terminals (not shown) provided on the other surface of the housing 20*a*. This push switch 20 is housed within the through hole 31*b* of the holder 31, and each terminal (not shown) is connected to the printed circuit board 30 by soldering.

The push button 21 has a circular plate-shaped upper wall 21*a*, a side wall 21*b* extended from the outer peripheral edge portion of the upper wall 21*a* in a direction perpendicular to the upper wall 21*a*, and a rectangular through hole 21*c* provided at a predetermined place of the upper wall 21*a*.

The light guiding body 22 has a light-guiding unit 22*a* and an illuminating unit 22*b* provided at one end portion of the light-guiding unit 22*a*. The illuminating unit 22*b* of the light-guiding body 22 is inserted through the through hole 21*c* of the push button 21, and the illuminating unit 22*b* and the through hole 21*c* are fixed by press-fitting or the like.

The push slider 23 is made of synthetic resin material, is formed by fabrication, and has a cylindrical portion 23*a*, which is substantially cylindrical, a holding portion 23*b* (See FIG. 3) provided on one end portion side of the cylindrical portion 23*a*, and a driving unit 23*c* (See FIG. 3) having a cross-shaped cross section provided side by side on the holding portion 23*b*.

Within the holding portion 23*b* of the push slider 23, the light-guiding unit 22*a* of the light-guiding body 22 is housed and held.

Also, the push button 21 and the push slider 23 are engaged together by appropriate means such as, for example, snap-in engagement.

A compound switch device having the above-described structure is constructed such that the printed circuit board 30 is caught between the rotary switch 10 and the operating unit. At this time, the operating unit has a cylinder-shaped first operating member (rotating slider 17 and rotary knob 18) which is rotating, a second operating member (push button 21 and push slider 23) disposed within the first operating member, for being pressed in a direction parallel to the rotating shaft of the first operating member, a cylinder-shaped holding portion (cylinder-shaped slider 19) for holding the first operating member and the second operating member, and a protruded portion (strut 19*b*) protruding outwardly from the holding portion.

Next, the description will be made of an operation of this compound switch device.

First, the operation of the rotary switch 10 will be explained. When the operating unit 18*a* of the rotary knob 18 is rotated in a clockwise direction or in an anti-clockwise direction, for example, with a finger or the like, the rotation of this rotary knob 18 is transmitted to the rotating slider 17.

The compound switch device is constructed such that the rotation of the rotary slider 15 causes the movable contact portion 13 to rotate together, and to slidably contact on each stationary contact portion 12, and each contact portion is switched so as to obtain electric characteristics made variable.

Thus, the rotary slider 15 is rotated as described above, and at this time, one surface of the protruded portion 15*c* of the rotary slider 15 is rotated so as to run along the outer peripheral edge portion of the proximal portion 30*a* of the printed circuit board 30. This rotary slider 15 rotates until the protruded portion 15*c* abuts against the end portion of the derived portion 30*c* of the printed circuit board 30, and by means of this abutting against the end portion of the derived portion 30*c*, the rotation of the rotary slider 15 is regulated. In other words, the derived portion 30*c* functions as a so-called stopper This regulation of the rotation of the rotary slider 15 is similarly applied to either rotation in the clockwise direction or in the anti-clockwise direction.

Next, the description will be made of an operation of the push switch 20. When the push button 21 is pressed, for example, with a finger or the like, this push button 21 moves in a direction parallel to the rotating shaft of the rotary switch 10. This movement of the push button 21 moves the push slider 23 in a direction parallel to the rotating shaft of the rotary switch 10 in the same manner.

This movement of the push slider 23 causes the driving unit 23*c* of the push slider 23 to press the operating unit 20*b* of the push switch 20, and by this operating unit 20*b* being pressed, the push switch 20 is operated ON and OFF.

Next, when the push button 21 is released from the pressure, the push slider 23 is pushed back to the original position by the own resilience of the push switch 20, and at this time, the push button 21 is similarly pushed back to the original position (initial position).

The structure is arranged such that by switching such ON and OFF operation of the push switch 20 as described above, lighting and lights-out of, for example, the light source 32 are performed, and a predetermined function such as, for example, switching of a defroster of a rear window can be switched.

As described above, a compound switch device according to the present invention is constructed such that the printed circuit board is placed on the housing of the rotary switch so as to oppose to the rotary disk; the operating unit is placed on the printed circuit board so as to dispose the illuminated element and the push switch within the operating unit by causing the protruded portion of the holding portion to penetrate the through hole of the printed circuit board; the operating unit is arranged such that the second operating member opposes to the push switch and is illuminated by the illuminated element; the protruded portion of the holding portion is fixed to the rotary switch to cause the printed circuit board to be caught between the rotary switch and the operating unit; and the protruded portion of the rotary switch is engaged with the first operating member of the operating unit, whereby the rotary switch and the push switch are laminated through the printed circuit board, and exhibits the effects that it is possible to miniaturize the external (direction of diameter) dimension of this compound switch device, and to assemble only by fixing the rotary switch to the holding portion of the operating unit for making them integral, and the assembly is easy.

The protruded portion of the rotary disk of the rotary switch rotates along the outer peripheral edge portion of the printed circuit board, and the range of rotation of the rotary disk is regulated by the protruded portion abutting against a part of the printed circuit board, whereby the printed circuit board can be used as the rotary stopper of the rotary switch, and this leads to the effect that it is possible to reduce the number of components and to provide the compound switch device according to the present invention at low cost.

Also, the compound switch device according to the present invention consists of the rotary switch, which is a switch for switching a large current, and the push switch, which is a switch for switching a small current, whereby it is possible to provide a compound switch device having a switch function capable of switching different currents.

What is claimed is:

1. A compound switch device having a rotary switch, a printed circuit board in which an illuminated element and a push switch are connected together, and an operating unit, the rotary switch having a housing, a rotary disk disposed within the housing, and a protruded portion formed on the rotary disk, protruding outwardly from the housing;

the printed circuit board having a through hole;

the operating unit having a cylindrical first operating member which is rotating, a second operating member disposed within the first operating member, for being pressed in a direction parallel to a rotating shaft of the first operating member, a cylindrical holding portion for holding the first operating member and the second operating member, and a protruded portion for protruding outwardly from the holding portion;

the printed circuit board being placed on the housing for the rotary switch so as to oppose to the rotary disk; the operating unit being placed on the printed circuit board so as to arrange the illuminated element and the push switch within the operating unit by causing the protruded portion of the holding portion to penetrate the through hole of the printed circuit board; the second operating member being caused to oppose to the push switch and to be illuminated by the illuminated element;

the protruded portion of the holding portion being fixed to the rotary switch; the printed circuit board being caught between the rotary switch and the operating unit; the protruded portion of the rotary switch being engaged with the first operating member of the operating unit; by means of rotation of the first operating member, the rotary disk being rotated to operate the rotary switch; and by pressing the second operating member, the push switch being operated.

2. The compound switch device according to claim 1, wherein the protruded portion of the rotary disk of the rotary switch rotates along an outer peripheral edge portion of the printed circuit board, and a range of rotation of the rotary disk is regulated by the protruded portion abutting against a part of the printed circuit board.

3. The compound switch device according to claim 1, wherein the rotary switch is a switch for switching a large current and the push switch is a switch for switching a small current.

4. The compound switch device according to claim 2, wherein the rotary switch is a switch for switching a large current and the push switch is a switch for switching a small current.

* * * * *